US006821167B2

(12) United States Patent
Ishigaki et al.

(10) Patent No.: US 6,821,167 B2
(45) Date of Patent: Nov. 23, 2004

(54) OUTBOARD MOTOR

(75) Inventors: Eiichi Ishigaki, Kagawa (JP); Saburo Tonomura, Tokyo (JP)

(73) Assignee: Ishigaki Company Limited, Tokyo (JP)

( * ) Notice: Subject to any disclaimer, the term of this patent is extended or adjusted under 35 U.S.C. 154(b) by 0 days.

(21) Appl. No.: 10/239,851

(22) PCT Filed: Jan. 31, 2002

(86) PCT No.: PCT/JP02/00790

§ 371 (c)(1),
(2), (4) Date: Oct. 1, 2002

(87) PCT Pub. No.: WO02/062659

PCT Pub. Date: Aug. 15, 2002

(65) Prior Publication Data

US 2003/0104733 A1 Jun. 5, 2003

(30) Foreign Application Priority Data

Feb. 8, 2001 (JP) ..... 2001-032298
Feb. 14, 2001 (JP) ..... 2001-036736

(51) Int. Cl.[7] ..... B63H 11/00
(52) U.S. Cl. ..... 440/38; 440/67; 440/72
(58) Field of Search ..... 440/38, 66, 67, 440/71, 72, 76, 78, 113

(56) References Cited

U.S. PATENT DOCUMENTS 4,281,996 A * 8/1981 Mouraret ..... 440/89 R
5,325,662 A 7/1994 Varney et al.
5,769,674 A * 6/1998 Stallman ..... 440/38
5,964,626 A * 10/1999 Varney et al. ..... 440/38
6,059,618 A * 5/2000 Purnell et al. ..... 440/38

FOREIGN PATENT DOCUMENTS

| | | |
|---|---|---|
| EP | 759394 | 2/1997 |
| JP | 49-73196 | 6/1974 |
| JP | 50-12672 | 5/1975 |
| JP | 5-85471 | 4/1993 |
| JP | 6-35277 | 2/1994 |
| JP | 6-35277 | 5/1994 |
| JP | 7-89489 | 4/1995 |
| JP | 9-193894 | 7/1997 |
| JP | 9-309492 | 12/1997 |
| JP | 2000168687 | 6/2000 |
| JP | 2000326894 | 11/2000 |

OTHER PUBLICATIONS

English Language Abstract for JP Appln. No. 2000–168687.
English Language Abstract for JP Appln. No. 9–193894.
English Language Abstract for JP Appln. No. 9–309492.
English Language Abstract for JP Appln. No. 6–35277.
English Language Abstract for JP Appln. No. 2000–326894.
English Language Abstract for JP Appln. No. 5–85471.
English Language Abstract for JP Appln. No. 7–89489.

* cited by examiner

*Primary Examiner*—Jesus D. Sotelo
(74) *Attorney, Agent, or Firm*—Greenblum & Bernstein, P.L.C.

(57) ABSTRACT

An outboard motor which includes a driving motor, a switching device, an impeller and a blade casing. The switching device switches rotation of a drive shaft of the driving motor between normal and reverse directions. The impeller is rotated with a driven shaft connected to the switching device. The blade casing includes a first duct member and a second duct member. The first duct member has first opening through which water is sucked from the outside when the impeller is rotated in the normal direction. The second duct member connected to the first duct member encloses the impeller, and has a second opening through which water is sucked from the outside when the impeller is rotated in the reverse direction.

20 Claims, 11 Drawing Sheets

OUTBOARD MOTOR

TECHNICAL FIELD

The present invention relates to an outboard motor, and in particular, to an improvement to a blade casing.

BACKGROUND ART

For a conventional outboard motor, which has a propeller extending downward from a bottom of a ship so as to be under water, there is a possibility that the propeller is damaged by being caught in seaweed or cord-like objects such as a net or by being brought into contact with sands or rock, resulting in reduced thrust. The accidental contact of a human with the propeller results in injury or death.

Japanese Patent Application Laid-Open No. 12(2000)-168687 discloses a housing provided to the periphery of a propeller so as to prevent a propeller extending into water from being caught in seaweed and the like. However, since an opening of the housing is oriented to the forward running direction of a ship, debris and cord-like objects are likely to enter the housing. Therefore, there is the possibility that the propeller and a propeller shaft incur damage.

A water jet propulsion outboard motor disclosed in Japanese Patent Application Laid-Open No. 7(1995)-89489 reverses a water jet causing a large energy loss upon the reverse running of a ship. With lowered thrust during reverse running, the maneuverability of the ship when getting close to the shore is inferior to that of a conventional propeller outboard motor. Furthermore, a reverser employed to reverse the water jet makes the outboard motor elongated in a longitudinal direction of the ship.

DISCLOSURE OF INVENTION

In view of the conventional problems as described above, the present invention has an object of providing a small and light-weight safety outboard motor with enhanced thrust efficiency.

In order to achieve the above object, an outboard motor according to a first aspect of the present invention comprises: a driving motor; a switching device for switching rotation of a drive shaft of the driving motor between normal and reverse directions; the impeller rotated with a driven shaft connected to the switching device; and a blade casing including a first duct member having a first opening through which water is sucked from outside when the impeller is rotated in the normal direction and a second duct member for enclosing the impeller, connected with the first duct member, the second duct member having a second opening though which water is sucked from the outside when the impeller is rotated in the reverse direction.

According to the first aspect, the direction of rotation of the impeller can be changed by the switching device. When the impeller is rotated in the normal direction, water is sucked through the first opening from the outside and is discharged through the second opening. When the impeller is rotated in the reverse direction, water is sucked through the second opening from the outside and is discharged through the first opening.

Therefore, in the case where the first opening is provided so as to be oriented in a forward direction of a ship whereas the second opening is provided so as to be oriented in a backward direction of the ship, the reverse rotation of the impeller causes the water to be jetted out through the first opening toward the forward direction of the ship, so that the ship can run in the backward direction.

An outboard motor according to a second aspect of the present invention is the outboard motor according to the first aspect, wherein the second opening is adjacent to the impeller.

According to the second aspect, since the second opening is adjacent to the impeller, the blade casing extending in a backward direction of the ship can be shorter, reducing the weight of the outboard motor. Moreover, water flow resistance within the blade casing is reduced.

An outboard motor according to a third aspect of the present invention is the outboard motor of the first aspect, wherein the blade casing includes a bearing rotatably supporting the driven shaft.

An outboard motor according to a fourth aspect of the present invention is the outboard motor of the third aspect, wherein the bearing is provided on the first duct member.

According to the above aspects, since the switching device is fixed to the bearing provided on the first duct member, length of the driven shaft is reduced and the outboard motor becomes compact as well as light-weight.

An outboard motor according to a fifth aspect of the present invention is the outboard motor of the third aspect, wherein the bearing is fixed to a support extending inward from an inner surface of the blade casing.

An outboard motor according to a sixth aspect of the present invention is the outboard motor of the fifth aspect, wherein the bearing rotatably supports an end of the driven shaft.

According to the above aspects, since both ends of the driven shaft are rotatably supported, vibration due to rotation is reduced. Moreover, straightening effects for a water jet can be obtained by the support.

An outboard motor according to a seventh aspect of the present invention is the outboard motor of the fifth aspect, wherein the support is a guide blade.

According to the seventh aspect, since a plurality of guide blades are provided behind the impeller, a swirl flow which is pressurized with the impeller is straightened into a linear flow to be jetted out through the second opening, contributing to increased thrust.

An outboard motor according to an eighth aspect of the present invention is the outboard motor of the third aspect, wherein the switching device is fixed to the bearing.

An outboard motor according to a ninth aspect of the present invention is the outboard motor of the eighth aspect, wherein the drive shaft penetrates through the blade casing.

According to the above aspects, since the switching device is arranged within the blade casing, the driven shaft is shortened, reducing vibration. Moreover, the outboard motor is reduced in size as well as weight.

An outboard motor according to a tenth aspect of the present invention is the outboard motor of the first aspect, wherein the impeller includes a cylindrical hub and axial flow blades; and an inner surface of the second duct member adjacent to the radially outer edges of the axial flow blades, is cylindrical.

According to the tenth aspect, since the amount of discharged water upon normal rotation of the axial flow blades is approximately equal to that upon reverse rotation, the thrust obtained when the ship runs in a reverse direction can be equivalent to that obtained when the ship runs in a forward direction. By switching the rotation of the axial flow blades between normal and reverse directions, a running direction of the ship can be changed to a forward/backward direction within a short period of time.

An outboard motor according to an eleventh aspect of the present invention is the outboard motor of the first aspect, wherein the impeller comprises a conical hub and diagonal flow blades; and an inner surface of the second duct member adjacent to the radially outer edges of the diagonal flow blades, is conical.

According to the eleventh aspect, since the front suction portions of the radially outer edges of the diagonal flow blades for guiding an entering water flow are wide open, suction efficiency is improved to increase thrust during running in a forward direction. Moreover, balance efficiency is enhanced with a plurality of the diagonal flow blades.

An outboard motor according to a twelfth aspect of the present invention is the outboard motor of the first aspect, wherein the impeller comprises a conical hub and axial flow blades; and an inner surface of the second duct member adjacent to radially outer edges of the axial flow blades, is cylindrical.

According to the twelfth aspect, since the hub has a conical shape, the suction performance with the axial flow blades can be close to that obtained with the diagonal flow blades.

An outboard motor according to a thirteenth aspect of the present invention is the outboard motor of the first aspect, wherein the blade casing is detachably divided.

An outboard motor according to a fourteenth aspect of the present invention is the outboard motor of the thirteenth aspect, wherein the blade casing is divided into one on a first opening side and the other on a second opening side.

An outboard motor according to a fifteenth aspect of the present invention is the outboard motor of the thirteenth aspect, wherein the blade casing is divided by a plane including the drive shaft and the driven shaft.

According to the above aspects, the attachment, removal, inspection and repair of the outboard motor are facilitated.

An outboard motor according to a sixteenth aspect of the present invention is the outboard motor of the thirteenth aspect, wherein the impeller is a propeller.

An outboard motor according to a seventeenth aspect of the present invention is the outboard motor of the sixteenth aspect, wherein the outboard motor further comprises: a housing for mounting the driving motor; and an attachment member for fixing the blade casing to the housing, detachably attached to the housing.

According to the above aspects, even in an existing outboard motor with the propeller extending downward from a bottom of the ship, the propeller is protected during running on shallows such as in the vicinity of the shoreline or on a river because the blade casing encloses the propeller and the lower casing. Moreover, accidental contact with the propeller resulting in injury or death is prevented.

With a suction port of the blade casing oriented in a downward direction, the amount of debris and cord-like objects entering the suction port can be reduced. Therefore, the propeller is not easily caught in debris and cord-like objects.

Furthermore, since the blade casing is divided into two parts, i.e., right and left parts, and detachably attached via the attachment member, the blade casing can be readily employed on an existing outboard motor and propeller, and facilitates the inspection and repair of the propeller.

BEST MODE FOR CARRYING OUT THE INVENTION

Hereinafter, embodiments of the present invention will be described in detail with reference to the drawings. In the following description, the term "forward" means a forward direction with respect to a running direction of a ship, and "reverse" means a backward direction with respect to the running direction of the ship.

First Embodiment

Figure 1:
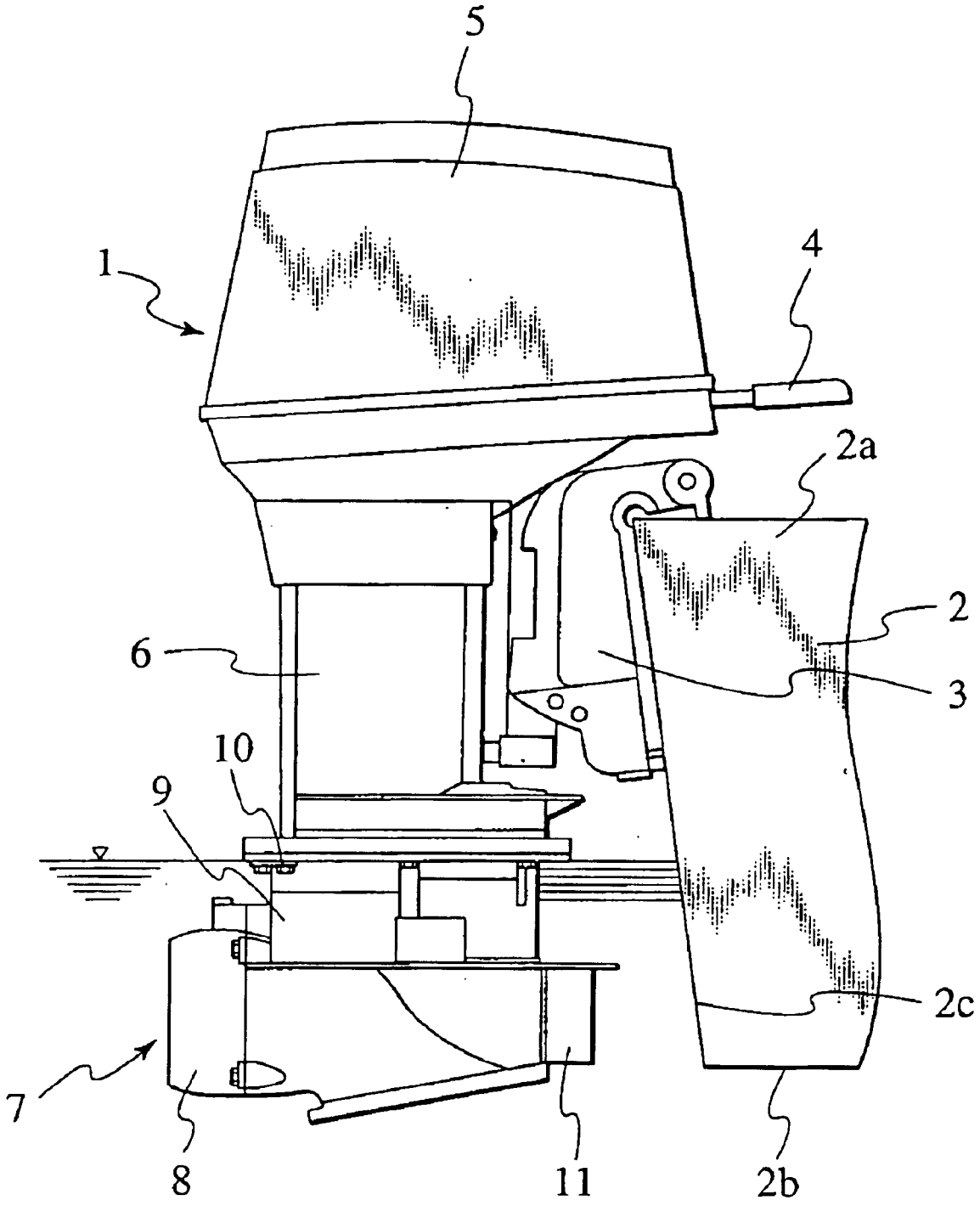
FIG. 1 is a side view of an outboard motor according to a first embodiment of the present invention.

As shown in FIG. 1, an outboard motor 1 is detachably mounted onto a transom board 2*a* of a ship 2 through a bracket 3. The operation of a driving motor and the steering are performed with an operation lever 4.

Figure 2:
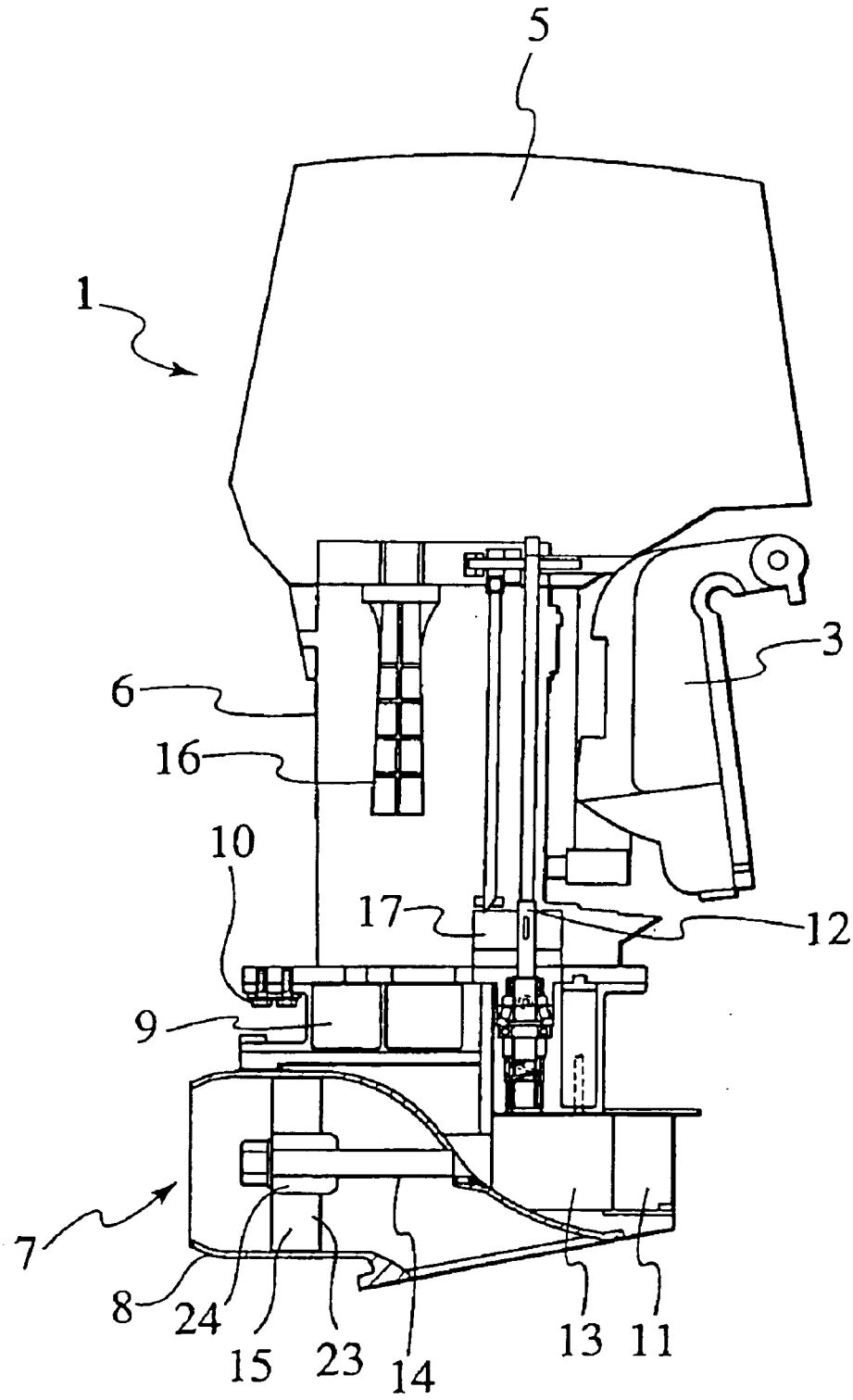
FIG. 2 is a longitudinal cross-sectional view of the outboard motor shown in FIG. 1.

As shown in FIGS. 1 and 2, the outboard motor 1 comprises an engine 5 as a driving motor, a housing 6, a drive shaft 12, a propulsion device 7, and an attachment member 9.

The drive shaft 12, which is directly connected to the engine 5, extends downward from the engine 5 to be connected to a forward/backward switching device 13 of the propulsion device 7.

A blade casing 8 of the propulsion device 7 is fixed through the attachment member 9 to the housing 6 on which the engine 5 is mounted. The attachment member 9 is fixed to a lower end of the housing 6 with bolts 10.

The housing 6 is provided with an exhaust pipe 16 and a cooling water pump 17 for the engine 5. An eddy plate 11 is provided between the ship 2 and the propulsion device 7.

Figure 3:
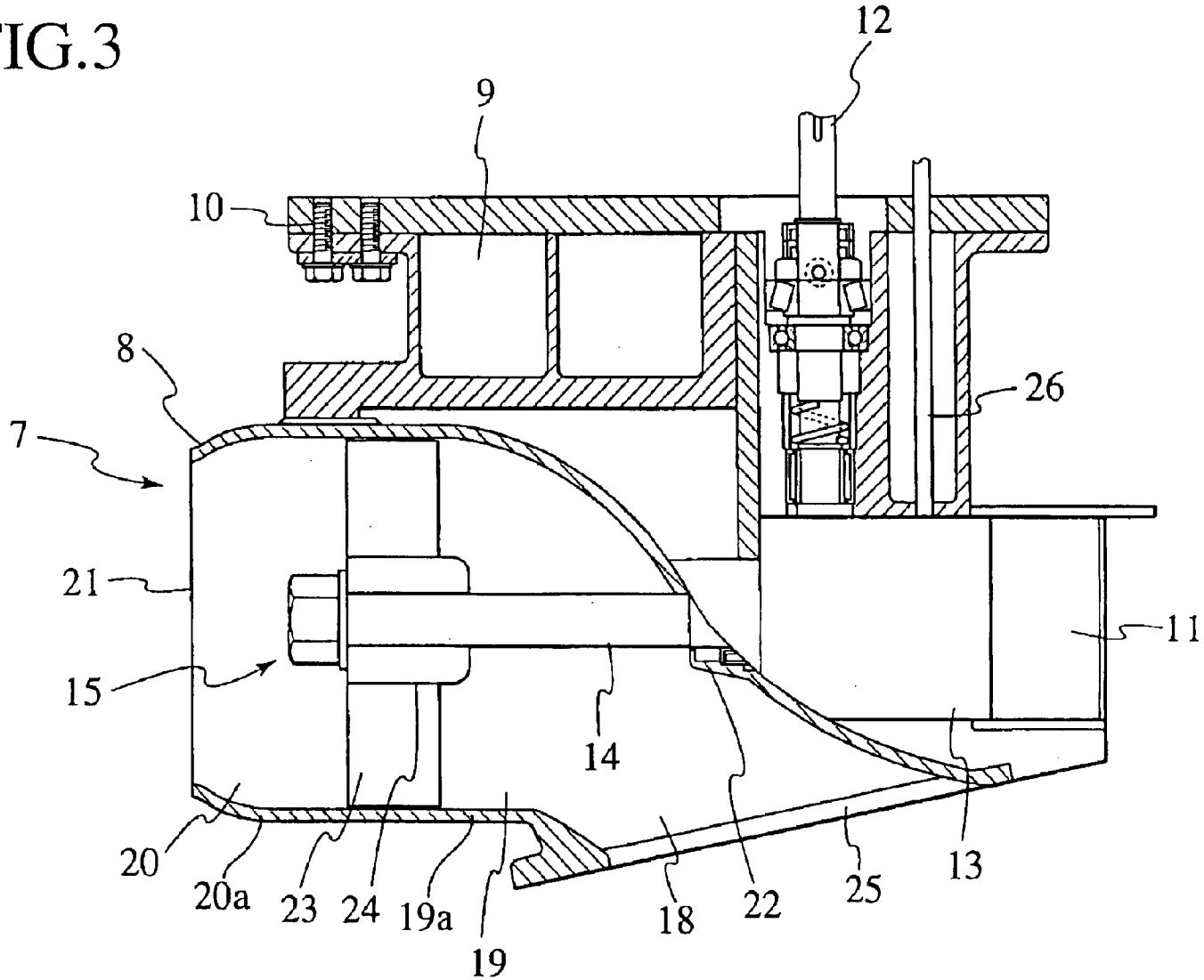
FIG. 3 is a longitudinal cross-sectional view of a propulsion device of the outboard motor shown in FIG. 1.

As shown in FIG. 3, the propulsion device 7 includes the blade casing 8, a bearing 22, the forward/backward switching device 13, a driven shaft 14, and an impeller 15.

The blade casing 8 has a suction duct member 19*a* (first duct member) defining a bent tube-like suction flow path 19 with a suction port 18 (first opening) on its bottom, and a blade chamber wall 20*a* (second duct member) defining a blade chamber 20 enclosing the impeller 15, which is connected to the rear of the suction duct member 19*a* and has a discharge port 21 (second opening) on the rear end.

The suction port 18, situated on the bottom of the outboard motor 1, is provided under the water at the same level as a bottom 2*b* of the ship, and is slightly inclined in a forward direction.

The discharge port 21 is provided under the water in the vicinity of the bottom 2*b* of a stern 2*c*, and is adjacent to the impeller 15.

The bearing 22 is provided on the suction duct member 19*a* of the blade casing 8 to rotatably support the driven shaft 14.

The forward/backward switching device 13 is fixed to the bearing 22. By means of up/down operation of a shift rod 26, the forward/backward switching device 13 switches to and from normal and reverse rotations of the drive shaft 12 and transmits the forward and backward rotations to the driven shaft 14.

The driven shaft 14, connected to the forward/backward switching device 13, extends backward from the forward/backward switching device 13 and penetrates through the suction duct member 19*a* of the blade casing 8 to the blade chamber 20.

The impeller 15 is constituted of a cylindrical hub 24 fitted into an end of the driven shaft 14 and a plurality of axial flow blades 23 connected to the hub 24, each having a small width. The impeller 15 is rotated with the driven shaft 14.

A screen 25 is provided over the suction port 18.

According to the first embodiment, since the suction port 18 of the blade casing 8 is situated on the bottom of the outboard motor 1 and is provided under the water at the same level as the bottom 2*b*, the propulsion device 7 does not protrude beyond the bottom 2*b*. As a result, the impeller 15 or the blade casing 8 can be prevented from being damaged due to contact with obstacles such as sand or rocks in shallows. At the same time, an accident resulting in injury or death due to contact with the impeller 15 can be prevented from occurring. Moreover, the amount of debris or cord-like objects entering in through the suction port 18 is reduced because the suction port 18 is open in a downward direction. Furthermore, since the suction port 18 is slightly inclined in a forward direction, a water flow is prone to enter through the suction port 18 during the running of the ship.

Since the discharge port 21 is adjacent to the impeller 15, the length of the blade casing 8 protruding in a rear direction from the stern is reduced, resulting in reduction in weight of the propulsion device 7. Moreover, owing to this structure, water flow resistance within the blade casing 8 is reduced.

As the forward/backward switching device 13 is fixed to the bearing 22 provided on the suction duct member 19*a* of the blade casing 8, the length of the driven shaft 14 can be reduced and the propulsion device 7 is compact as well as light-weight.

The impeller 15 is constituted of the axial flow blades 23, and the discharge port 21 is positioned under the water. Therefore, the reverse rotation of the impeller 15 by use of the forward/backward switching device 13 causes the water sucked through the discharge port 21 to be jetted out through the suction port 18 in a forward direction of the ship, whereby the ship 2 can run in a reverse direction.

Since the amount of discharged water upon normal rotation of the axial flow blades 23 is approximately equal to that upon reverse rotation, a large thrust, which is equal to that obtained when the ship 2 runs in forward, can be obtained even when the ship 2 runs in reverse. By switching the rotation direction of the axial flow blades 23 between a normal direction and a reverse direction, a running direction of the ship 2 can be changed to a forward/backward direction within a short period of time.

Since the screen 25 is provided over the suction port 18, a water flow during running of the ship 2 sweeps debris or cord-like objects along the screen 25 in a rearward direction. Therefore, debris or cord-like objects do not easily enter into the blade casing 8. Moreover, the rotation of the impeller 15 in a reverse direction allows debris or cord-like objects clogging the screen 25 to be washed away.

Owing to the eddy plate 11 provided between the ship 2 and the propulsion device 7, water does not easily splash over the ship.

Second Embodiment

Next, a second embodiment will be described with reference to FIG. 4. The same components as those in the first embodiment are denoted by the same reference numerals, and description thereof is omitted.

Figure 4:
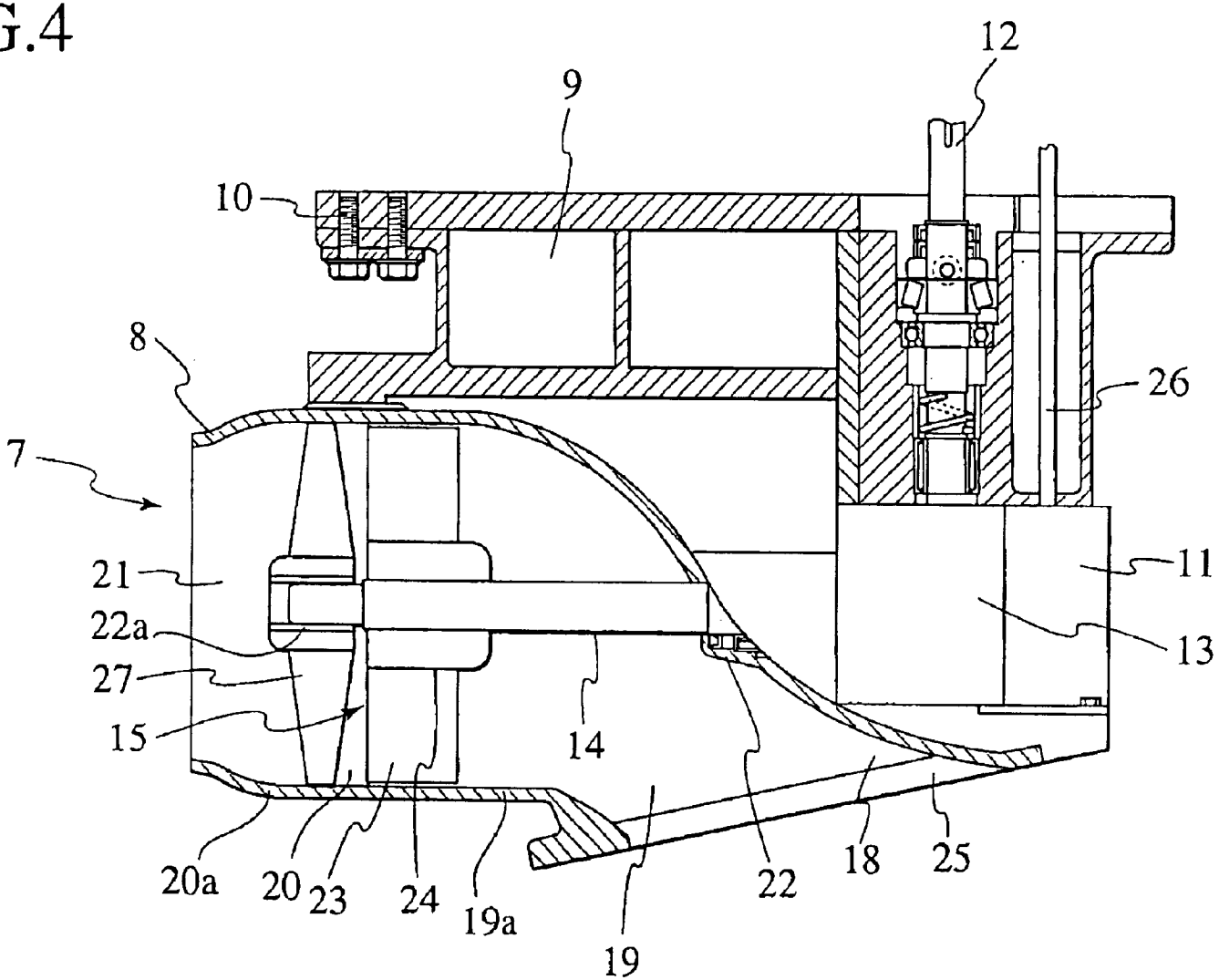
FIG. 4 is a longitudinal cross-sectional view of a propulsion device of an outboard motor according to a second embodiment of the present invention.

As shown in FIG. 4, an end of the driven shaft 14 is rotatably supported by a bearing 22*a* fixed onto a support 27 extending inward from the inner surface of the blade casing 8.

According to the second embodiment, since both ends of the driven shaft 14 are rotatably supported, vibration due to rotation are reduced. Moreover, straightening effects for a water jet can be obtained owing to the support 27.

Third Embodiment

Next, a third embodiment will be described with reference to FIG. 5. The same components as those in the first embodiment are denoted by the same reference numerals, and the description thereof is omitted.

Figure 5:
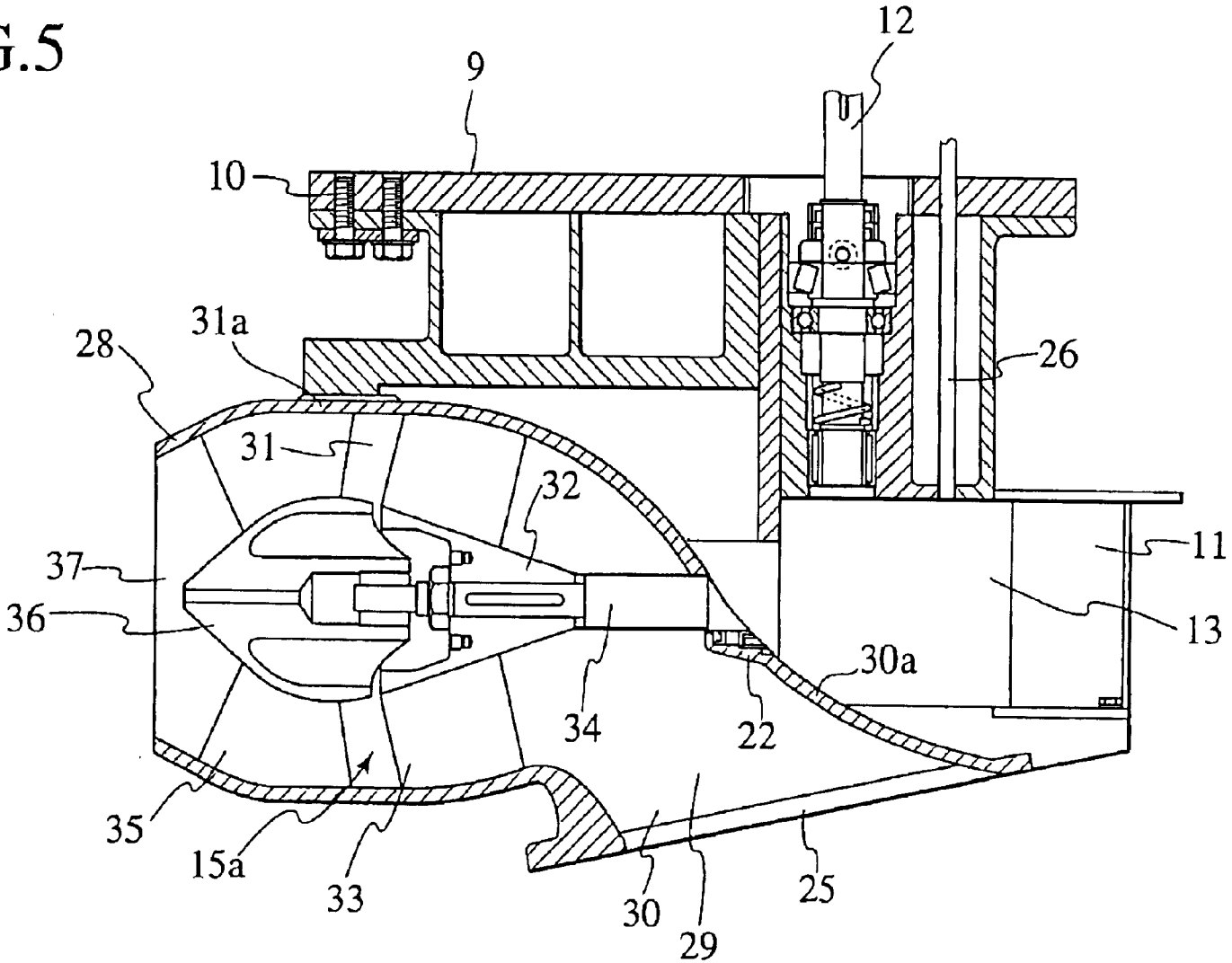
FIG. 5 is a longitudinal cross-sectional view of a propulsion device of an outboard motor according to a third embodiment of the present invention.

As shown in FIG. 5, a blade casing 28 has a suction duct member 30*a* defining a bent tube-like suction flow path 30 with a suction port 29 on the bottom, and a blade chamber wall 31*a* defining a barrel-shaped blade chamber 31 enclosing an impeller 15*a*, which is connected to the rear of the suction duct member 30*a* and has a discharge port 37 on the rear end.

The impeller 15*a* is constituted of a conical hub 32 fitted into a driven shaft 34 and a plurality of diagonal flow blades 33 connected to the hub 32. The impeller 15*a* is rotated with the driven shaft 34.

An end of the driven shaft 34 is rotatably supported by a blade boss 36 which is fixed to a plurality of guide blades 35 extending inward from the inner surface of the blade casing 28.

According to the third embodiment, since a plurality of the guide blades 35 are provided behind the impeller 15*a*, a swirl flow, which is pressurized with the impeller 15*a*, is straightened into a linear flow to be jetted out through the discharge port 37. As a result, thrust is increased.

Since the front suction portions of the radially outer edges of the diagonal flow blades 33 are wide open so as to guide an entering water flow, suction efficiency is improved to increase thrust during running in a forward direction. Moreover, balance efficiency is enhanced by a plurality of the diagonal flow blades 33.

Fourth Embodiment

Next, a fourth embodiment will be described with reference to FIG. 6. The same components as those in the first embodiment are denoted by the same reference numerals., and description thereof is omitted.

Figure 6:
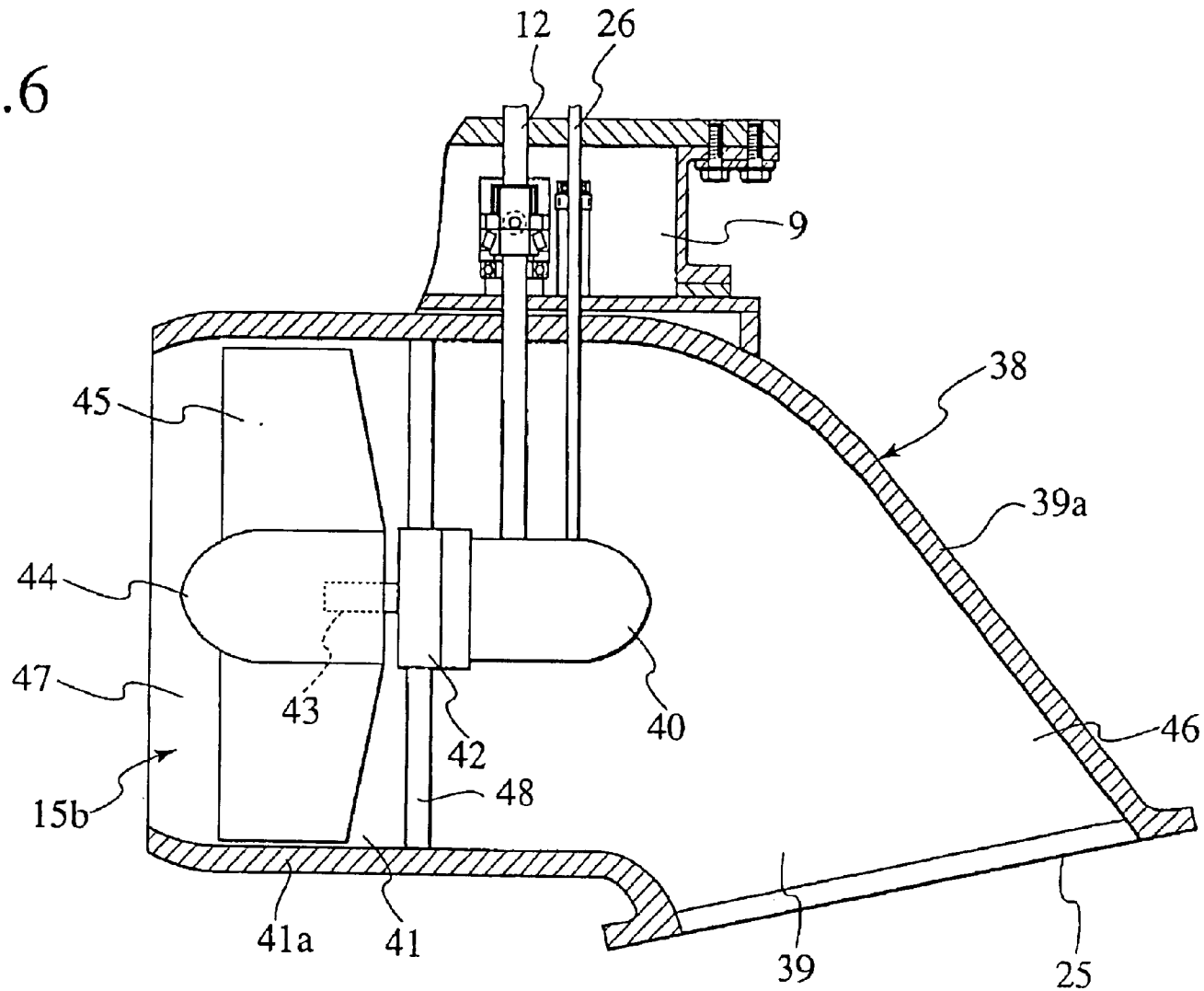
FIG. 6 is a longitudinal cross-sectional view of a propulsion device of an outboard motor according to a fourth embodiment of the present invention.

As shown in FIG. 6, a blade casing 38 has a suction duct member 39*a* defining a bent tube-like suction flow path 39 with a suction port 46 on the bottom, and a blade chamber wall 41*a* defining a cylindrical blade chamber 41 enclosing an impeller 15*b*, which is connected to the rear of the suction duct member 39*a* and has a discharge port 47 on the rear end.

The drive shaft 12 directly connected to the engine 5 penetrates through an upper wall of the blade casing 38 to be connected to a forward/backward switching device 40 provided within the suction flow path 39.

The forward/backward switching device 40 is fixed to the bearing 42. By means of an up/down operation of a shift rod 26, the forward/backward switching device 40 switches to and from normal and reverse rotations of the drive shaft 12 and transmits the forward and backward rotations to the driven shaft 43.

The driven shaft 43, connected to the forward/backward switching device 40, extends backward from the forward/backward switching device 40.

The bearing 42 is fixed to a support 48 extending inward from the inner surface of the blade casing 38 to rotatably support the driven shaft 43.

The impeller 15*b* is constituted of a hub 44 fitted into an end of the driven shaft 43 and a plurality of axial flow blades 45 each having a small width connected to the hub 44. The impeller 15*b* is rotated with the driven shaft 43.

According to the fourth embodiment, since the forward/backward switching device 40 is placed within the blade casing 38, a length of the driven shaft 43 is reduced. As a result, vibration is reduced. Moreover, the propulsion device 7 is reduced in size as well as weight.

Fifth Embodiment

Next, a fifth embodiment will be described with reference to FIG. 7. The same components as those in the fourth embodiment are denoted by the same reference numerals, and description thereof is omitted.

Figure 7:
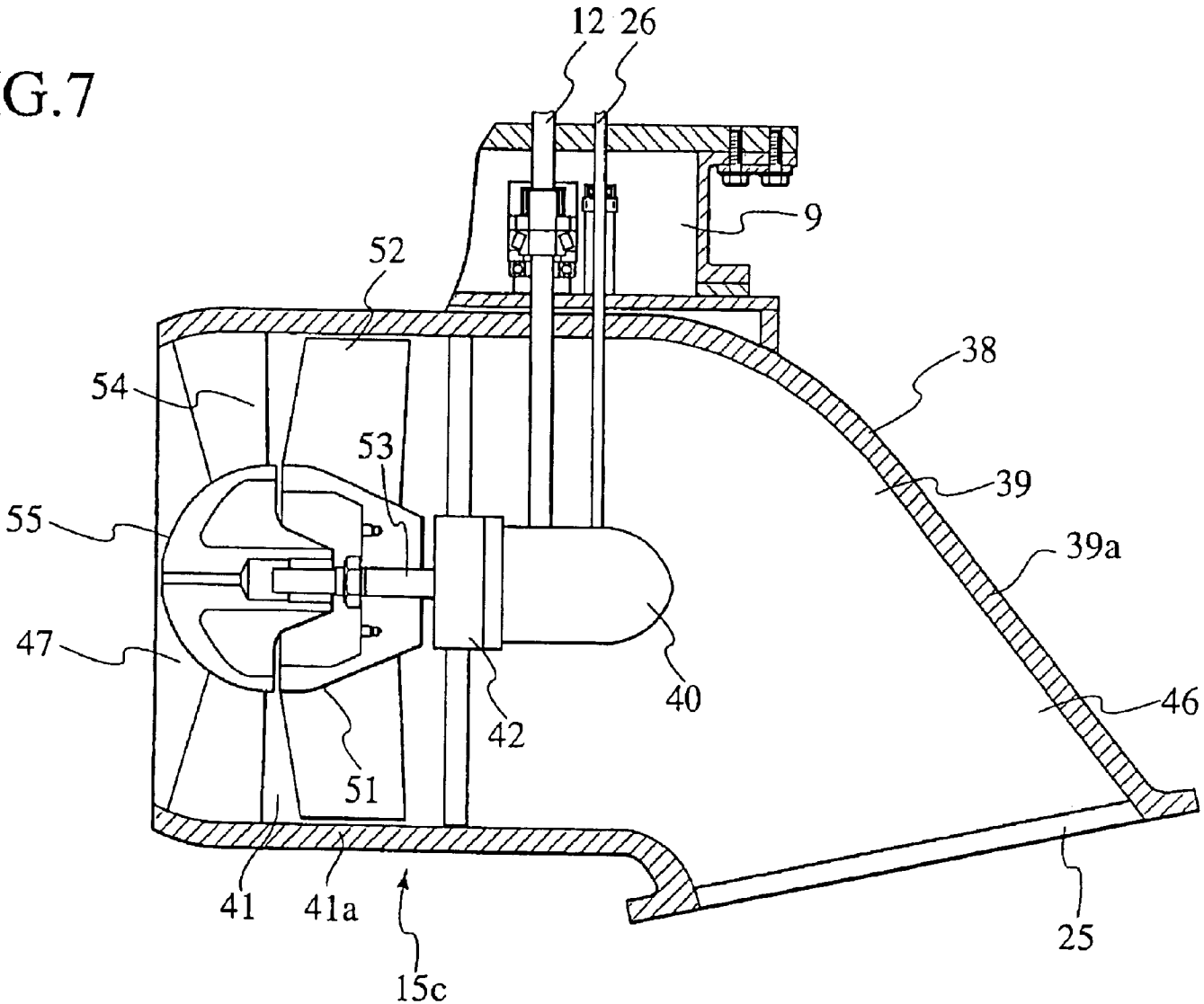
FIG. 7 is a longitudinal cross-sectional view of a propulsion device of an outboard motor according to a fifth embodiment of the present invention.

As shown in FIG. 7, an impeller 15*c* is constituted of a conical hub 51 fitted into a driven shaft 53 and a plurality of axial flow blades 52 connected to the hub 51. The impeller 15*c* is rotated with the driven shaft 53.

An end of the driven shaft 53 is rotatably supported by a blade boss 55 which is fixed to a plurality of guide blades 54 extending inward from the inner surface of the blade casing 38.

According to the fifth embodiment, since a plurality of the guide blades 54 are provided behind the impeller 15*c*, a swirl flow, which is pressurized with the impeller 15*c*, is straightened into a linear flow to be jetted out through the discharge port 47. As a result, thrust is increased.

Moreover, since the hub 51 has a conical shape, a suction performance which is close to that obtained with diagonal flow blades can be obtained even with the axial flow blades 52.

Each of the blade casings 8, 28 and 38 according to first through fifth embodiments may be divided so as to be removable and attachable from/to the housing 6.

Figure 8:
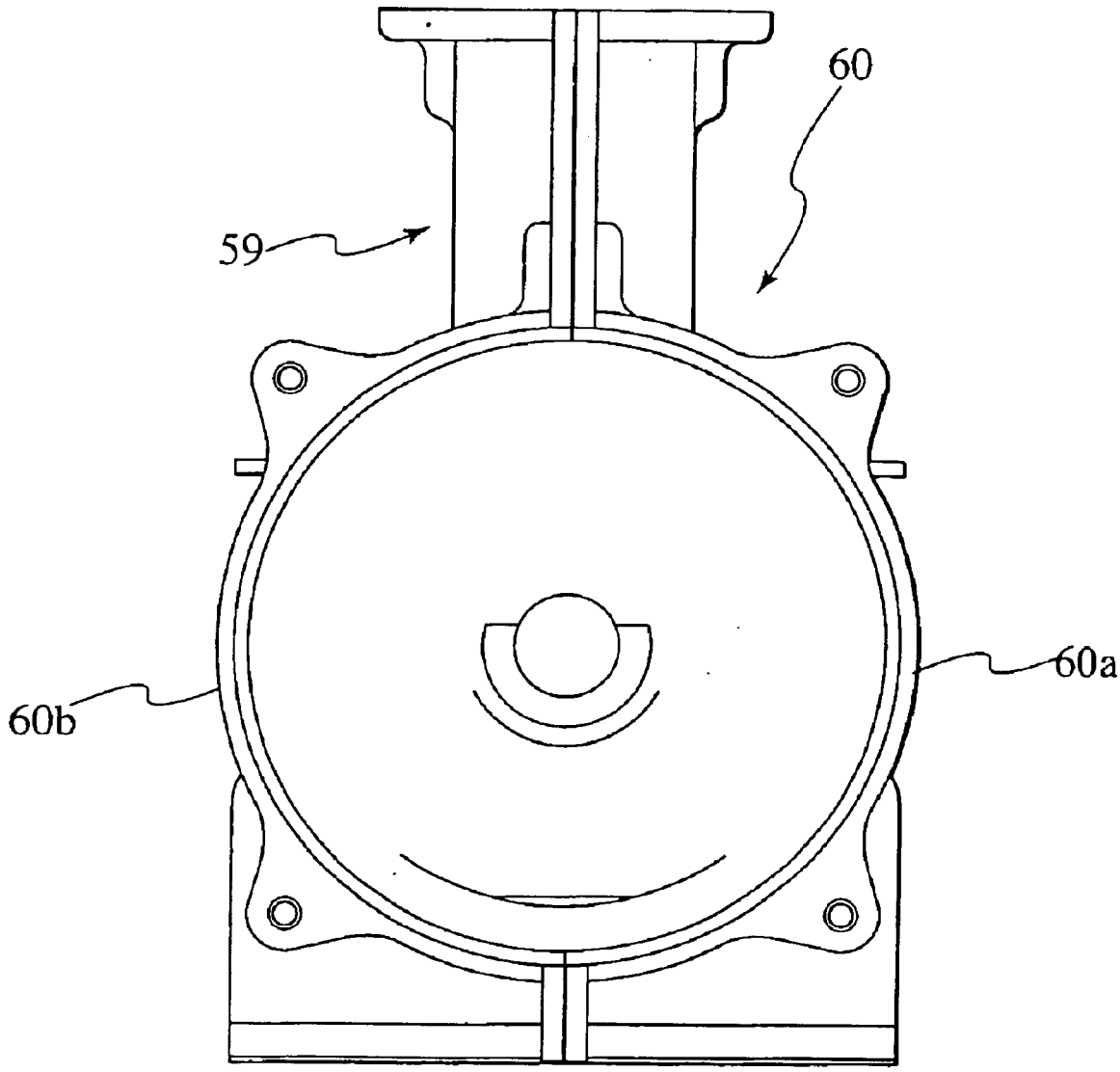
FIG. 8 is a front view of a blade casing, divided by a plane including a drive shaft and a driven shaft.

As shown in FIG. 8, a blade casing 60 fixed to a lower end of an attachment member 59 is divided into a right blade casing 60*a* and a left blade casing 60*b* by a plane including the drive shaft 12 and the driven shaft 14, 34, 43 or 53.

Figure 9:
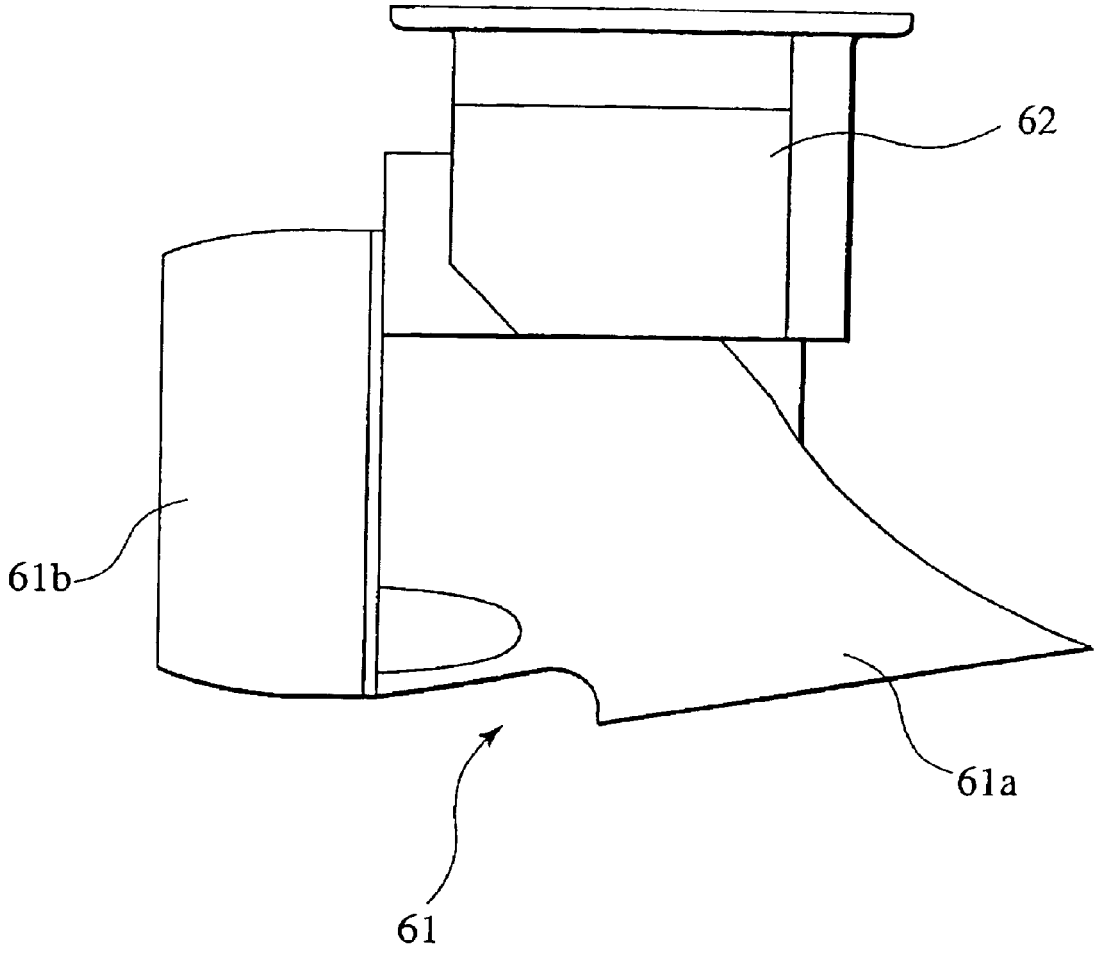
FIG. 9 is a side view of a blade casing divided into one on a first opening side and the other on a second opening side.

As shown in FIG. 9, a blade casing 61 fixed to a lower end of an attachment member 62 is divided into a suction port side blade casing 61*a* and a discharge port side blade casing 61*b*.

Such a structure facilitates the attachment, removal, inspection, and repair of the propulsion device 7.

Sixth Embodiment

Next, a sixth embodiment will be described with reference to FIG. 10. The same components as those in the fifth embodiment are denoted by the same reference numerals, and description thereof is omitted.

Figure 10:
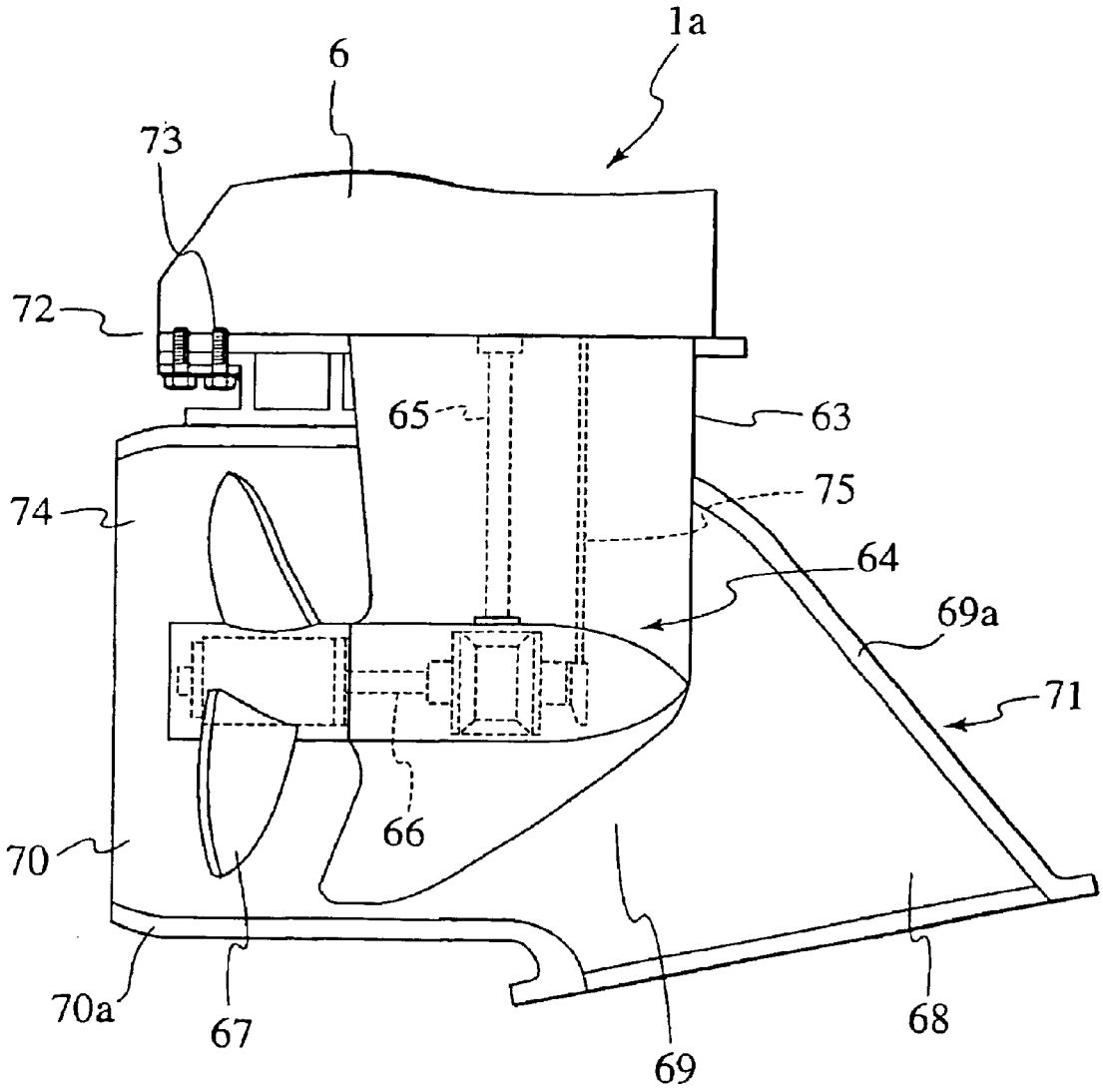
FIG. 10 is a longitudinal cross-sectional view of a propulsion device of an outboard motor according to a sixth embodiment of the present invention.

As shown in FIG. 10, an outboard motor 1*a* includes the housing 6, an attachment member 72, a blade casing 71, a drive shaft 65, a forward/backward switching device 64, a driven shaft 66 and a propeller 67.

To the lower end of the housing 6 on which an engine (not shown) is mounted, the blade casing 71 is detachably attached through the attachment member 72 fixed to the housing 6 with bolts 73.

The blade casing 71 is constituted of a suction duct member 69*a* defining a bent tube-like suction flow path 69 with a suction port 68 on the bottom, and a blade chamber wall 70*a* defining a cylindrical blade chamber 70 enclosing the propeller 67 and a lower casing 63, being continuously connected to the rear of the suction duct member 69*a* and having a discharge port 74 on the rear end. Furthermore, the blade casing 71 is divided into two parts, i.e., a right part and a left part, by a plane including the drive shaft 65 and the driven shaft 66.

The suction port 68, situated on the bottom of the outboard motor 1*a*, protrudes below the bottom 2*b* (FIG. 1) of the ship so as to be under the water and is slightly inclined in a forward direction.

The forward/backward switching device 64 is provided within the lower casing 63. By means of the operation of a shift rod 75, the forward/backward switching device 64 switches to and from normal and reverse rotations of the drive shaft 65 and transmits the forward and backward rotations to the driven shaft 66.

The driven shaft 66 is connected to the forward/backward switching device 64, and extends backward from the forward/backward switching device 64.

The propeller 67 is fixed to an end of the driven shaft 66, and is rotated with the driven shaft 66.

According the sixth embodiment, even in an existing outboard motor including the propeller 67 extending downward from the bottom 2*b* (FIG. 1), the propeller 67 is protected during running on shallows such as in the vicinity of the shoreline or on the river because the blade casing 71 encloses the propeller 67 and the lower casing 63. Moreover, an accident resulting in injury or death due to contact with the propeller 67 is prevented from occurring.

Since the suction port 68 of the blade casing 71 is open in a downward direction, the amount of debris or cord-like objects entering inside through the suction port 68 is reduced. Therefore, the propeller 67 is not easily caught in debris or cord-like objects.

Furthermore, since the blade casing 71, which is divided in two parts, i.e., a right part and a left part, is detachably attached through the attachment member 72 with the bolts 73, the blade casing 71 can be easily attached even to an existing outboard motor having the propeller 67. Moreover, this structure facilitates the inspection and repair of the propeller 67.

Next, the forward/backward switching devices 13 and 40 according to first through fifth embodiments will be described with reference to FIG. 11.

Figure 11:
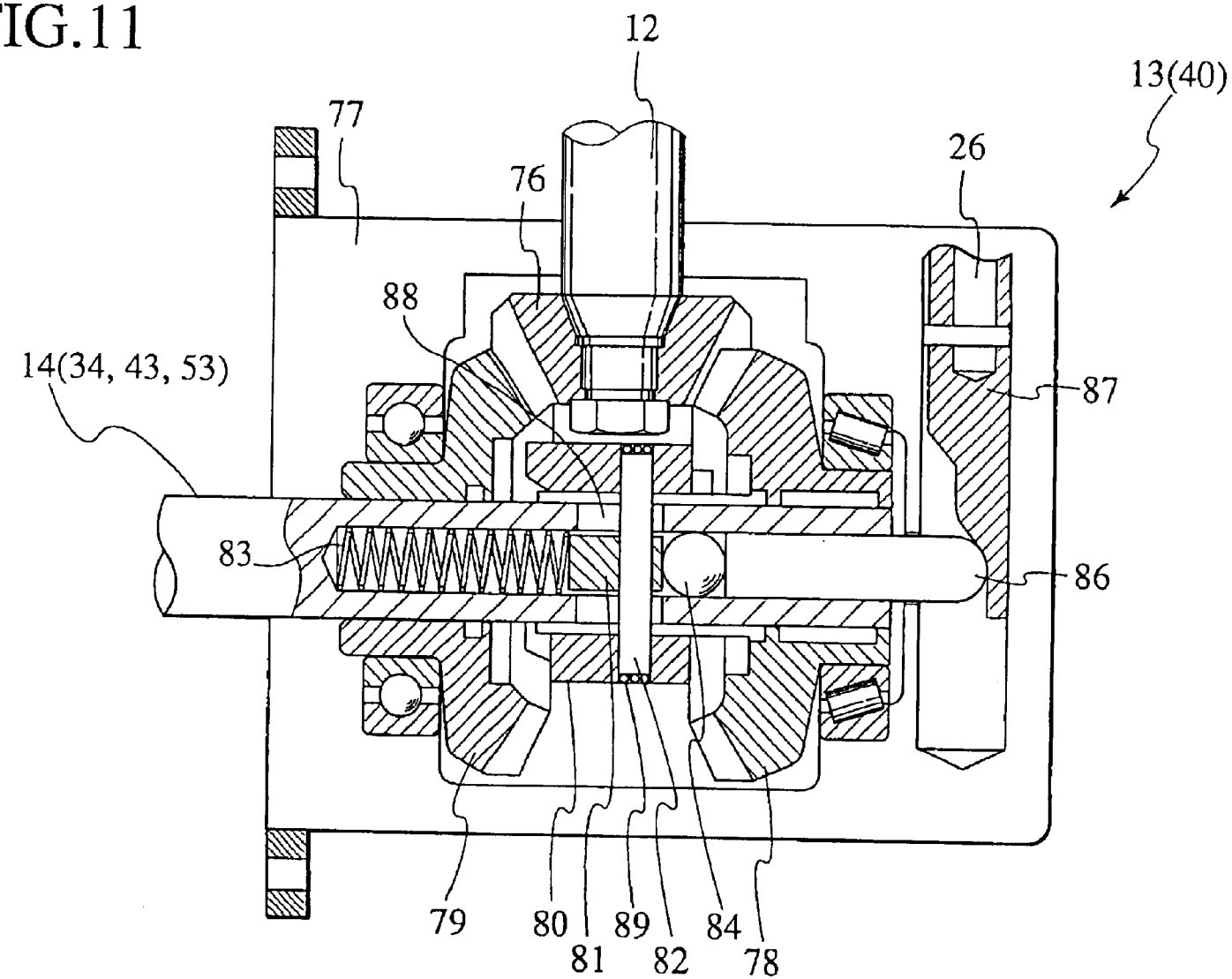
FIG. 11 is a longitudinal cross-sectional view of a forward/backward switching device according to the first to fifth embodiments of the present invention.

As shown in FIG. 11, the forward/backward switching device 13 or 40 includes a gear case 77, a driving gear 76, a forward gear 78, a reverse gear 79, a clutch 80, a cam rod 86, and a spring 83.

The driving gear 76 is fitted into a lower end of the drive shaft 12 directly connected to the engine, and meshes with the forward gear 78 and the reverse gear 79 which are rotatably supported within the gear case 77 so as to be opposed to each other.

The driven shaft 14 is provided so as to extend into the gear case 77, passing through the forward gear 78, the reverse gear 79 and the clutch 80 between the gears.

A hole extending in an axial direction is provided on an end of the driven shaft 14, into which the spring 83, a spring holder 81, a ball bearing 84 and the cam rod 86 are inserted.

The spring 83 always pushes the cam rod 86 in a shaft end direction of the driven shaft 14 via the spring holder 81 and the ball bearing 84.

An end of the cam rod 86 protrudes from the end of the driven shaft 14, and is always in contact with a vertically movable shift cam 87 which is connected to the shift rod 26.

In the part of the clutch 80 through which the driven shaft 14 passes, a guide slot 88 which penetrates along a line perpendicular to an axis of the driven shaft 14 and extends in an axial direction of the driven shaft 14 is provided.

A clutch pin 82 passes through the spring holder 81 and penetrates through the guide slot 88 to be inserted into the clutch 80. A coil spring 89 prevents the clutch pin 82 from displacing.

The clutch 80 is guided along the guide slot 88 with the clutch pin 82 to move in the axial direction of the driven shaft 14 so as to be fitted into the forward gear 78 or the reverse gear 79.

The downward movement of the shift rod 26 causes the downward movement of the shift cam 87, so that the cam rod 86 in contact with the shift cam 87 is pushed into the driven shaft 14. As a result, the spring 83 is compressed to cause the movement of the clutch 80 along with the spring holder 81, the ball bearing 84 and the clutch pin 82 toward the side of the reverse gear 79. When the clutch 80 is fitted into the reverse gear 79 in this manner, the rotation of the reverse gear 79 is transferred to the driven shaft 14 via the clutch pin 82 to cause the rotation of the impeller 15 in the reverse direction.

The upward movement of the shift rod 26 causes the upward movement of the shift cam 87, so that the cam rod 86 in contact with the shift cam 87 is pushed out from the driven shaft 14 due to the pressing force of the spring 83. As a result, the spring 83 is stretched to cause the movement of the clutch 80 along with the spring holder 81, the ball bearing 84 and the clutch pin 82 toward the side of the forward gear 78. When the clutch 80 is fitted into the forward gear 78 in this manner, the rotation of the forward gear 78 is transferred to the driven shaft 14 via the clutch pin 82 to cause the rotation of the impeller 15 in the normal direction.

INDUSTRIAL APPLICABILITY

As described above, according to an outboard motor of the present invention, a blade casing and a driven shaft can be reduced in length and the outboard motor can be compact as well as light-weight. A second opening of the blade casing is placed under the water. Therefore, when a direction of rotation of an impeller is reversed, water sucked through the second opening is jetted out in a forward direction of a ship through a first opening so that the ship can efficiently run in reverse. Moreover, the blade casing prevents an impeller from being damaged due to contact with obstacles such as sand or rocks in shallows. Moreover, an accident resulting in injury or death due to contact with the impeller can be prevented, thereby improving the safety of running of the ship. Thus, the outboard motor of the present invention is useful as an outboard motor.

What is claimed is:

1. An outboard motor comprising:

a driving motor;

a switching device that switches a rotation direction of a drive shaft of the driving motor between forward and reverse directions;

an impeller rotated with a driven shaft connected to the switching device;

a blade casing including a first duct member having a first opening through which water is taken-in from outside when the impeller is rotated in the forward direction and a second duct member for enclosing the impeller, connected with the first duct member, the second duct member having a second opening through which water is taken-in from the outside when the impeller is rotated in the reverse direction;

a housing for mounting the driving motor; and an attachment member that secures the blade casing to the housing, said attachment member being attachable to and detachable from both the housing and the blade casing.

2. An outboard motor according to claim 1, wherein the second opening is adjacent to the impeller.

3. An outboard motor according to claim 1, wherein the blade casing includes a first bearing for rotatably supporting the driven shaft.

4. An outboard motor according to claim 3, wherein the first bearing is provided on the first duct member.

5. An outboard motor according to claim 3, wherein a second bearing is provided on a support extending inward from an inner surface of the blade casing.

6. An outboard motor according to claim 5, wherein the second bearing rotatably supports an end of the driven shaft.

7. An outboard motor according to claim 5, wherein the support comprises guide blades.

8. An outboard motor according to claim 3, wherein the switching device is secured to the first bearing.

9. An outboard motor according to claim 8, wherein the drive shaft penetrates through the blade casing.

10. An outboard motor according to claim 1, wherein the impeller comprises a cylindrical hub and axial flow blades; and an inner surface of the second duct member, adjacent to radially outer edges of the axial flow blades, is cylindrical.

11. An outboard motor according to claim 1, wherein the impeller comprises a conical hub and diagonal flow blades; and an inner surface of the second duct member, which is adjacent to the radially outer edges of the diagonal flow blades, is conical.

12. An outboard motor according to claim 1, wherein the impeller comprises a conical hub and axial flow blades; and an inner surface of the second duct member, which is adjacent to radially outer edges of the axial flow blades, is cylindrical.

13. An outboard motor according to claim 1, wherein the blade casing is detachably divided.

14. An outboard motor according to claim 13, wherein the blade casing is divided into one portion on a first opening side and another portion on a second opening side.

15. An outboard motor according to claim 13, wherein the blade casing is divided by a plane including the drive shaft and the driven shaft.

16. An outboard motor according to claim 13, wherein the impeller comprises a propeller.

17. An outboard motor according to claim 1, wherein the first and second duct members of the blade casing cooperate to define a curved water flow path with the first opening thereof opening downward and being situated on the bottom of the outboard motor.

18. An outboard motor according to claim 1, further comprising:

an eddy plate provided in front of the first duct member of the blade casing.

19. An outboard motor according to claim 1, further comprising:

a screen provided on the first opening of the first duct member of the blade casing.

20. An outboard motor comprising:

a driving motor;

a switching device that switches a rotation direction of a drive shaft of the driving motor between forward and reverse directions;

an impeller rotated with a driven shaft connected to the switching device; and a blade casing including a first duct member having a first opening through which water is taken in from outside when the impeller is rotated in the forward direction and a second duct member having a second opening through which water is taken-in from the outside when the impeller is rotated in the reverse direction, wherein the first and second duct members of the blade casing cooperate to define a curved water flow path with the first opening thereof opening downward and being situated on the bottom of the outboard motor.

* * * * *